United States Patent [19]

Ono

[11] 4,207,069

[45] Jun. 10, 1980

[54] METHOD OF PRINTING CELLULOSE FIBER AND POLYESTER/CELLULOSE MIXED FIBER

[75] Inventor: Masahiko Ono, Kasukabe, Japan

[73] Assignee: Toppan Printing Co., Ltd., Tokyo, Japan

[21] Appl. No.: 771,678

[22] Filed: Feb. 24, 1977

[30] Foreign Application Priority Data

Feb. 26, 1976 [JP] Japan ..... 51-20507

[51] Int. Cl.[2] ..... D06P 3/82; D06P 3/60

[52] U.S. Cl. ..... 8/471; 8/532

[58] Field of Search ..... 8/21 C, 93, 25 R, 25 A, 8/54.2

[56] References Cited

U.S. PATENT DOCUMENTS

| | | | |
|---|---|---|---|
| 2,911,280 | 11/1959 | Cicogna | 8/2.5 R |
| 3,706,525 | 12/1972 | Blackwell et al. | 8/94 A |
| 3,707,346 | 12/1972 | Markert | 8/2.5 A |
| 3,782,896 | 1/1974 | Defago et al. | 8/2.5 A |
| 4,027,345 | 6/1971 | Fujisawa et al. | 8/2.5 R |
| 4,029,467 | 6/1977 | Defago et al. | 8/2.5 A |
| 4,058,644 | 11/1977 | De Vries | 8/2.5 A |
| 4,059,471 | 11/1977 | Haigh | 8/2.5 |

FOREIGN PATENT DOCUMENTS

| | | | |
|---|---|---|---|
| 2436783 | 7/1974 | Fed. Rep. of Germany | 8/2.5 |

OTHER PUBLICATIONS

Leimbacher, Chem. Abstract, vol. 83, 1975, Abstract 116,871.

Salvin, Amer. Dyestuff Rep., Jun. 5, 1967, pp. 31–35.

*Primary Examiner*—John Kight, III

*Attorney, Agent, or Firm*—Frishauf, Holtz, Goodman, Woodward

[57] ABSTRACT

A method of printing cellulose fiber and polyester/cellulose mixed fiber which comprises pretreating a cellulose fiber or polyester/cellulose mixed fiber with a solution containing a swelling agent for cellulose fiber, and then printing the fiber with an oil-soluble dye or disperse dye. The printed fiber resulting from this method is excellent in internal dyeability, color density, and the color fastness.

5 Claims, No Drawings

METHOD OF PRINTING CELLULOSE FIBER AND POLYESTER/CELLULOSE MIXED FIBER

This invention relates to a method of printing cellulose fiber and polyester/cellulose mixed fiber, and more particularly to such a method which involves printing a cellulose fiber or polyester/cellulose mixed fiber with an oil soluble dye or disperse dye.

Generally, cellulose fiber has very low dyeability with oil-soluble dyes and disperse dyes. Therefore, textiles of cellulose fiber and polyester/cellulose mixed fiber have conventionally been printed with vat dyes, naphthol dyes, direct dyes, etc. by passing through a number of processing steps such as printing, steaming, soaping, resin treatment for crease or shrink proofing, and the like. The use of oil-soluble dyes and disperse dyes for printing purposes was found to have the disadvantage of causing the fiber surfaces to be decolorized during soaping. In order to prevent the decolorization during soaping, it is conceivable to eliminate the soaping by subjecting the fiber surfaces to resin treatment. However, this process was also found to have the disadvantage of causing the fiber surfaces to be decolorized by the resin solution.

As an alternative approach, there is known the dry transfer printing process which does not require the inclusion of soaping. This process involves placing on the cloth to be printed a temporary carrier bearing what is called a sublimable, oil soluble dye or disperse dye of the type which migrates through sublimation, vaporization, or hot melting (i.e., a transfer paper printed with an ink containing such a dye), and then heating the combination to effect the transfer of the dye. In printing a cellulose fiber by this process, the cellulose fiber is preliminarily treated with a synthetic resin capable of being dyed with oil-soluble dyes or disperse dyes to coat the fiber surfaces with a film of resin which is then subjected to transfer printing. With this process, however, the hygroscopicity inherent to cellulose fiber is impaired because the fiber surfaces are coated with a film of synthetic resin, and a deep tone of color is hard to obtain because the dye serves mainly to color the surface of the film and hardly migrates into the fiber.

It is an object of this invention to provide a method of printing cellulose fiber and polyester/cellulose mixed fiber which will permit good printing with an oil-soluble dye or disperse dye.

In accordance with this invention, there is provided a method of printing cellulose fiber and polyester/cellulose mixed fiber which comprises pretreating a cellulose fiber or polyester/cellulose mixed fiber with a solution containing a swelling agent for cellulose fiber, and then printing the fiber with an oil-soluble dye or disperse dye.

The present method involves pretreating the fiber to be printed with a solution containing a swelling agent for cellulose fiber, thereby overcoming the difficulties heretofore encountered in printing cellulose fiber and polyester/cellulose fiber with an oil-soluble dye or disperse dye. As a result of the pretreatment with a solution containing a swelling agent for cellulose fiber, molecules of the agent penetrate into the interstices between micelles of the cellulose fiber to enlarge the interstices and thereby facilitate diffusion and migration of the dye into the cellulose fiber. After the pretreatment with a solution containing a swelling agent, the cellulose fiber may be intermediately dried to such an extent as not to interfere with its swollen state at the time of printing.

The cellulose fibers which can be printed by the present method include natural cellulose fibers such as cotton, hemp, etc. and man-made cellulose fibers such as rayon, etc. These fibers may be in any desired form such as threads, woven fabrics, nonwoven fabrics, etc.

The swelling agent for cellulose fiber which is contained in the pretreating solution used in the present method may be any compound that has an affinity for cellulose fiber and shows the ability to promote diffusion and migration of the dye into the cellulose fiber. Preferably, it has a boiling point higher than 150° C. so that it may be evaporated during the drying step subsequent to the pretreatment. Illustrative swelling agents having a boiling point higher than 150° C., together with their respective boiling points in parentheses, include ethylene glycol (197.7°–197.8° C.), ethylene glycol monoethyl ether acetate (156.8° C.), ethylene glycol monoethyl ether (171.2° C.), ethylene glycol dibutyl ether (203.6° C.), ethylene glycol monobutyl ether acetate (191.5° C.), ethylene glycol isoamyl ether (181° C.), ethylene glycol monophenyl ether (237° C.), ethylene glycol monophenyl ether acetate (259.7° C.), ethylene glycol benzyl ether (256° C.), ethylene glycol monohexyl ether (208.3° C.), methoxymethoxyethanol (167.5° C.), ethylene glycol monoacetate (187°–188° C.), ethylene glycol diacetate (190.5° C.), diethylene glycol (245.0° C.), diethylene glycol monomethyl ether (194.2° C.), diethylene glycol monoethyl ether (195.0° C.), diethylene glycol monoethyl ether acetate (217.4° C.), diethylene glycol monobutyl ether (230.4° C.), diethylene glycol monobutyl ether acetate (246.8° C.), diethylene glycol dimethyl ether (159.6° C.), diethylene glycol diethyl ether (186° C.), diethylene glycol dibutyl ether (254.6° C.), diethylene glycol monoacetate (250° C.), triethylene glycol (276° C.), triethylene glycol monomethyl ether (249° C.), triethylene glycol monomethyl ether (255.6° C.), trigrycol dichloride (235° C.), tetraethylene glycol (327.3° C.), polyethylene glycol (mol. wt. 200–600), propylene glycol (188.2° C.), propylene glycol monobutyl ether (171.1° C.), 1-buthoxy ethoxy propanol (229.4° C.), polypropylene glycol, propylene glycol monoacetate (182°–183° C.), dipropylene glycol (229.2° C.), dipropylene glycol monomethyl ether (190° C.), dipropylene glycol monoethyl ether (197.8° C.), trimethylene glycol (214.2° C.), 1,3-butanediol (207.5°–207.8° C.), 2,3-butanediol (182° C.), 1,4-butanediol (235° C.), 1,5-pentanediol (242.5° C.), 3,4-hexylene glycol (197.1° C.), octylene glycol (244.2° C.), glycerol (290.0° C.), glyceryl diacetate (259°–261° C.), glyceryl triacetate (258°–259° C.), glyceryl monobutylate (269°–271° C.), glycerol $\alpha$-monomethyl ether (220° C.), glycerol $\alpha$, $\beta$-dimethyl ether (169° C.), glycerol monoisoamyl ether (251°–252° C.), glycerol $\alpha$, $\beta$-diisoamyl ether (265° C.), glycerol $\alpha$, $\gamma$-dichlorohydrin (213° C.), and trimethylolpropane (295° C.).

Especially when the dry transfer printing process using a transfer paper printed with an ink containing a sublimable, oil-soluble dye or disperse dye is employed for the printing step, it is desirable to use a swelling agent having a boiling point equal to or higher than about the transfer temperature. The reason for this is that, if the fiber pretreated with a solution containing a swelling agent whose boiling point is equal to or higher than about the transfer temperature is subjected to dry transfer printing, the swelling agent in a state of vapor or liquid will keep the fiber swollen at the time of transfer and thereby facilitate diffusion and migration of the dye into the cellulose fiber. On the other hand, if a swelling agent whose boiling point is lower than the transfer temperature is used, the swelling agent will undesirably be eliminated from the interstices between fiber micelles at the transfer temperature before performing its proper function of facilitating diffusion and migration of the dye into the cellulose fiber.

The oil-soluble dye or disperse dye which is used in the present method may be any of such dyes. Useful oil-soluble dyes include, for example, Solvent Yellow 93, Solvent Yellow 33, Solvent Orange 60, Solvent Violet 13, Solvent Red 24, Solvent Yellow 17, and Solvent Blue 35. Useful disperse dyes include, for example, C.I. Disperse Yellow Nos. 71, 51, 54, 5, 60, 192, 8, 64, 120, and 42; C.I. Disperse Red Nos. 54, 65, 191, 190, 60, 288, 192, 73, 188, 4, 15, 116, 132, 11, 152, 37, 38, and 43; C.I. Disperse Orange Nos. 13, 21, 157, and 66; C.I. Disperse Scarlet No. 50; C.I. Disperse Blue Nos. 72, 26, 81, 56, 60, 143, 73, 123, 87, 77, and 19; and C.I. Disperse Violet Nos. 26, 28, 23, 8, and 48.

Although the pretreating solution may be a solution (e.g., an aqueous solution) containing only a swelling agent as defined above, it is possible for the pretreating solution to further contain some additional components. Several examples are given in the following:

1. Pretreating solution containing a swelling agent, crosslinking agent, and crosslinking catalyst When cellulose fiber is pretreated with such a solution, the crosslinking agent comes to penetrate into the cellulose fiber. Subsequent heat treatment in the presence of the crosslinking catalyst causes the crosslinking agent to crosslink with the OH groups of the cellulose fiber or with itself and thereby stick fast to the cellulose fiber. As a result, the dye which penetrates into the cellulose fiber during the printing step is stably retained by the crosslinks between the crosslinking agent and the cellulose fiber or between molecules of the crosslinking agent, and is not eliminated even by subsequent soaping, so that the resulting printed fiber is excellent in tint color density, and color fastness. The heat treatment which brings about crosslinkage consists of steaming or baking subsequent to the printing step when a printing process involving no heating is employed, and consists of heating at the time of transfer when the dry transfer printing process using a transfer paper is employed.

The crosslinking agent and the crosslinking catalyst may be any compounds that perform their respective functions as defined above. Useful crosslinking agents include, for example, dimethylol urea, dimethylol ethylene urea, dimethylol propylene urea, dimethylol dihydroxyethylene urea, dimethyloluron, trimethylol melamine, trimethoxymethyl melamine, hexamethoxymethyl melamine, dimethylol methyltriazone, dimethylol ethyltriazone, dimethylol hydroxyethyltriazone, dimethylol methylcarbamate, dimethylol ethylcarbamate, dimethylol hydroxyethylcarbamate, N-methylolacrylamide, methylol glyoxal monourea, methylol glyoxal diurea, formaldehyde, tetraoxane, glyptal aldehyde, diepoxide, divinylsulfone, 4-methyl-5-dimethyl-dimethylol propane urea, and tetramethylol acetylene diurea. Useful crosslinking catalysts include, for example, organic acids such as acetic acid, maleic acid, etc.; ammonium salts such as ammonium chloride, ammonium sulfonate, diammonium hydrogenphosphate, etc.; amines such as ethanolamine chloride, 2-amino-2-methylpropanol hydrochloride, etc.; and metallic salts such as magnesium chloride, zinc nitrate, zinc chloride, zinc borofluoride, aluminum chloride, magnesium phosphate, etc.

When the fiber pretreated with a solution containing a swelling agent, crosslinking agent, and crosslinking catalyst is printed by a process involving heating, such as the dry transfer printing process, crosslinkage between the crosslinking agent and the cellulose fiber or between molecules of the crosslinking agent is brought about during the printing step. Prior to the printing step, the pretreated fiber may be intermediately dried to such an extent as not to allow the crosslinking agent to cure completely. In addition, soaping may be carried out before the transfer is effected. Even though soaping is carried out prior to the transfer, at least part of the swelling agent is not eliminated. The reason for this seems to be that the swelling agent is retained in the fiber by some action of the crosslinking agent. Where the crosslinking agent is provided to the fiber in an amount greater than required, soaping prior to the transfer is rather useful for the removal of excess of the crosslinking agent.

When the fiber pretreated with a solution containing a swelling agent, crosslinking agent, and cross linking catalyst is printed by a process involving no heating, heat treatment subsequent to the printing step is required. This heat treatment consists of steaming or baking.

As described above, when cellulose fiber or polyester/cellulose mixed fiber is pretreated with a solution containing a swelling agent, crosslinking agent, and crosslinking catalyst, resin treatment is effected at the time of heating whereby the printing process is greatly simplified as compared with the prior process. Moreover, the resulting printed fiber is more excellent in color density and color fastness.

2. Pretreating solution containing a swelling agent and a resin capable of being dyed with oil-soluble dyes or disperse dyes When cellulose fiber is pretreated with such a solution, the micelles of the cellulose fiber are kept in a swollen state by the action of the swelling agent, thus permitting diffusion and migration of the dye into the fiber at the time of heating. Moreover, the internal dyeability of the synthetic fiber is also improved. Since the pretreatment with this solution is followed by drying and curing of the resin film at temperatures upto 150° C., it is desirable to use a swelling agent having a boiling point higher than 150° C.

The resin which is used in this pretreating solution may be any resin that is capable of being dyed with oil-soluble dyes or disperse dyes. Useful resins include, for example, polyamide resin, urethane resin, polyvinyl chloride resin, polyvinyl acetate resin, polyester resin, acrylic resin, acetal resin, polyvinyl alcohol resin, vinylidene chloride resin, vinyl acetate resin, styrol resin, and polycarbonate resin.

Similarly, a printed fiber having improved internal dyeability, color density, and color fastness can also be obtained by using a pretreating solution containing a swelling agent, crosslinking agent, crosslinking catalyst, and resin capable of being dyed with oil-soluble dyes or disperse dyes.

The swollen cellulose fiber obtained from the pretreatment with a solution as described above may recrystallize before reaching the printing step, thus resulting in a reduction in dyeability. Such recrystallization of the cellulose fiber can be prevented by acetylating at least some of the OH groups of the cellulose fiber. Useful acetylating agents include, for example, acetic acid. While pyridine, ethylenediamine, aniline, benzylamine, zinc chloride, etc. may be used as a catalyzer, pyridine is preferred.

The above-described method of printing can overcome the difficulties heretofore encountered in printing cellulose fiber with an oil-soluble dye or disperse dye. Moreover, the resulting printed fiber is highly excellent in internal dyeability, color density, and color fastness. Furthermore, it retains the hygroscopicity and feeling inherent to cellulose fiber. Thus, the present method of printing has very great utility from a practical point of view.

In order to illustrate this invention more concretely, the following examples are given.

Examples 1 and 2 given below illustrate the case in which a solution containing only a swelling agent with a boiling point equal to or higher than the transfer temperature is used as the pretreating solution. For the printing step, the dry transfer printing process was employed in both examples.

EXAMPLE 1

Using a gravure proof press, a sheet of single starch-coated paper having at least a basis weight of 60 g/m$^2$ was printed on the starch-coated side with an ink having the following composition, whereby a transfer paper was formed.

| Ink Composition | | |
|---|---|---|
| Disperse Blue No.14 | 5 | parts by weight |
| Disperse Yellow No.51 | 5 | " |
| Ethyl Cellulose N-7 | 10 | " |
| Surface active agent | 1 | " |
| Isopropyl alcohol | 29 | " |
| Ethyl alcohol | 50 | " |

Then, a cloth made of polyester/cotton mixed fiber was dipped in a 15% aqueous solution of triethylene glycol (b.p. 276° C.) employed as the swelling agent for cellulose fiber, squeezed to an expression of 100%, and air-dried. Using the above-mentioned transfer paper, this cloth was printed under the transfer conditions defined by a temperature of 205° C., a pressure of 300 g/cm$^2$, and a period of 40 seconds. After soaping, the resulting polyester/cotton cloth printed in green had good feeling and excellent color fastness.

For purposes of comparison, the same procedure as described above was repeated, except that ethylene glycol (b.p. 197° C.) was employed as the swelling agent for cellulose fiber. The resulting printed polyester/cotton cloth showed unsatisfactory results. However, when the transfer temperature was reduced to 190° C., good results were achieved even with ethylene glycol employed as the swelling agent.

EXAMPLE 2

Excepting that the following compounds (other than polyhydric alcohols) were employed as the swelling agent, the same procedure as described in Example 1 was repeated with similar results.

Diethylene glycol monomethyl ether: (b.p. 193° C.)
Diethylene glycol monoethyl ether: (b.p. 202° C.)
Diethylene glycol n-butyl ether: (b.p. 231° C.)
Dipropylene glycol: (b.p. 232° C.)
Methoxytriethylene glycol acetate: (b.p. 244° C.)
Tetraethylene glycol: (b.p. 328° C.)

Examples 3 through 14 given below illustrate case in which a solution containing a swelling agent, crosslinking agent, and crosslinking catalyst is used as the pretreating solution. For the printing step, the process using a printing paste was employed in Examples 3–7 and the dry transfer printing process in Examples 8–14.

EXAMPLE 3

A broad cloth made of polyester (65% by weight)/cotton (35% by weight) mixed fiber was dipped in a pretreating solution having the following composition, squeezed to an expression of 80%, and then dried for 1 hour in a room having a temperature of 40° C. and a relative humidity of 20%.

| Pretreating Solution | | |
|---|---|---|
| Triethylene glycol | 15 | parts by weight |
| Methylol glyoxal monourea | 15 | parts by weight |
| Magnesium chloride | 5 | parts by weight |
| Water | 65 | parts by weight |

Then, a printing paste having the following composition was prepared.

| Printing Paste | | |
|---|---|---|
| Kayalon Turquoise Blue 776 (Trade name of a product manufactured by The Nihon Kayaku Company) | 5 | parts by weight |
| Warm water (at 50°–60° C.) | 40 | " |
| Paste | 55 | " |

The paste used in the above-mentioned printing paste had the following composition.

| Paste | | |
|---|---|---|
| Finishing locust bean gun (15%) | 60 | parts by weight |
| Modified carboxymethyl cellulose (10%) | 20 | parts by weight |
| Carboxymethyl starch (10%) | 20 | parts by weight |

Using a hand screen, the pretreated cloth was printed with the above-mentioned printing paste, dried at 50° C. for 3 minutes, and steamed at 190° C. for 60 minutes in an HT steamer. After soaping the resulting printed cloth showed an identical tint for the polyester and cotton portions, and had good color density and color fastness. Moreover, this printed cloth was resin-treated and had good feeling.

EXAMPLE 4

A cloth made of cotton fiber alone was printed in the same manner as in Example 3. The printed cloth again showed good results.

EXAMPLE 5

A broad cloth made of polyester (65% by weight)/cotton (35% by weight) was printed in the same manner as in Example 3, except that a pretreating solution having the following composition was used and dry heating at 190° C. for 80 seconds in thermosol was done in place of steaming. The obtained results were similar to those of Example 3.

| Pretreating Solution | | |
|---|---|---|
| Triethylene glycol | 15 | parts by weight |
| Methylol propylene urea | 15 | " |
| Magnesium chloride | 5 | " |
| Water | 65 | " |

EXAMPLE 6

A cloth made of cotton fiber alone was pretreated in the same manner as in Example 3. Then, a printing paste having the following composition was prepared.

| Printing Paste | | |
|---|---|---|
| Aizen Cathilon Pink BGH (Trade name of a product manufactured by the Hodogaya Kagaku Company | 5 | parts by weight |
| Warm water (at 50°-60° C.) | 40 | " |
| Paste | 55 | " |

The paste used in the above-mentioned printing paste had the following composition.

| Paste | | |
|---|---|---|
| Finishing locust bean gum (15%) | 60 | parts by weight |
| Modified carboxymethyl cellulose (10%) | 20 | " |
| Carboxymethyl Starch (10%) | 20 | " |

Using a hand screen, the pretreated cloth was printed with the above-mentioned printing paste, and air-dried. Then, it was cured at 155° C. for 3 minutes, steamed at 100° C. for 30 minutes in a batch type steamer, and soaped. The resulting printed cloth had both good color density and feeling.

EXAMPLE 7

A cloth made of cotton alone was printed in the same manner as in Example 6, except that a printing paste having the following composition was used. The obtained results were similar to those of Example 6.

| Printing Paste | | |
|---|---|---|
| Suminol Milling Orange SG (Trade name of a product manufactured by The Sumitomo Kagaku Company) | 5 | parts by weight |
| Warm water (at 50°-60° C.) | 40 | parts by weight |
| Paste | 55 | parts by weight |

EXAMPLE 8

A cloth made of polyester (65 parts by weight)/cotton (35 parts by weight) mixed fiber was dipped in a pretreating solution having the following composition, squeezed to an expression of 80%, and then dried for 1 hour in a room having a temperature of 40° C. and a relative humidity of 20%.

| Pretreating Solution | | |
|---|---|---|
| Triethylene glycol | 15 | parts by weight |
| Methylol glyoxal monourea resin | 15 | " |
| Magnesium chloride | 5 | " |
| Water | 65 | " |

Then, a sheet of single starch-coated paper having a basis weight of 60 g/m$^2$ was gravure printed with an ink having the following composition, whereby a transfer sheet was formed.

| Ink Composition | | |
|---|---|---|
| Sumikaron Blue E-FBL Powder (A product manufactured by The Sumitomo Kagaku Company) | 10 | parts by weight |
| Ethyl cellulose | 9 | " |
| Surface active agent | 1 | " |
| Isopropyl alcohol | 40 | " |
| Ethanol | 40 | " |

The above-mentioned transfer sheet was placed on the pretreated cloth and transferred under the conditions defined by a temperature of 210° C., a pressure of 300 g/cm$^2$, and a period of 40 seconds. After soaping, the cloth was found to be printed in a uniform and identical tint for the polyester and cotton portions, resin-treated, and provided with good feeling and color fastness. Thus, the resulting printed cloth had a good finish.

EXAMPLE 9

A cloth made of cotton fiber alone was pretreated in the same manner as in Example 8. Then, a transfer sheet similar to that of Example 8 was placed on the pretreated cloth and transferred under the same conditions as defined in Example 8. The resulting printed cloth had a good finish, just like that of Example 8.

EXAMPLE 10

A cloth made of polyester (65 parts of weight)/cotton (35 parts by weight) mixed fiber was dipped in a pretreating solution having the following composition, squeezed to an expression of 80%, and then dried for 1 hour in a room having a temperature of 40° C. and a relative humidity of 20%.

| Pretreating Solution | | |
|---|---|---|
| Glycerol | 15 | parts by weight |
| Dimethylol urea resin | 15 | " |
| Magnesium chloride | 5 | " |
| Water | 65 | " |

Then, a commercially available transfer paper for dry transfer printing use (manufactured by The Nihon Thermo Printex Company) was placed on the pretreated cloth and transferred under the same conditions as defined in Example 8. After soaping, the resulting printed cloth had a good finish.

EXAMPLE 11

A cloth made of cotton fiber alone was pretreated and printed in the same manner as in Example 10. The resulting printed cloth had a good finish.

EXAMPLE 12

A cloth made of polyester (65 parts by weight)/cotton (35 parts by weight) mixed fiber was dipped in a pretreating solution having the following composition, squeezed to an expression of 80%, and then dried for 1 hour in a room having a temperature of 40° C. and a relative humidity of 20%.

| Pretreating Solution | | |
|---|---|---|
| Triethylene glycol | 15 | parts by weight |
| Dimethylol ethylene urea resin | 15 | " |
| Magnesium chloride | 5 | " |
| Water | 65 | " |

Then, a transfer paper similar to that of Example 10 was placed on the pretreated cloth and transferred. After soaping, the resulting printed cloth had a good finish.

EXAMPLE 13

A cloth made of cotton alone was pretreated and printed in the same manner as in Example 12. The resulting printed cloth had a good finish.

EXAMPLE 14

A cloth made of polyester (65 parts by weight)/rayon (35 parts by weight) was dipped in a pretreating solution having the following composition, squeezed to an expression of 80%, and then dried for 1 hour in a room having a temperature of 40° C. and a relative humidity of 20%.

| Pretreating Solution | | |
|---|---|---|
| Triethylene glycol | 15 | parts by weight |
| Methylol melamine resin | 15 | " |
| Magnesium chloride | 5 | " |
| Water | 65 | " |

A transfer sheet similar to that of Example 10 was placed on the pretreated cloth and transferred under the same conditions as defined in Example 8. After soaping, the resulting printed cloth had a good finish.

Examples 15 and 16 given below illustrate the case in which a solution containing a swelling agent and a resin capable of being dyed with oil-soluble dyes or disperse dyes is used as the pretreating solution. For the printing step, the dry transfer printing process was employed in both examples.

EXAMPLE 15

A mercerized cotton cloth was dipped in a pretreating solution having the following composition, squeezed to an expression of 80%, and then dried in a hot-air oven at 110° C., whereby a resin-treated cotton cloth was formed.

| Pretreating Solution | | |
|---|---|---|
| Self-crosslinking acrylic resin emulsion (conc. 50%) | 80 | parts by weight |
| Triethylene glycol (b.p. 276° C.) | 10 | " |
| Water | 10 | " |

Using a commercially available transfer paper for dry transfer printing use (manufactured by The Nihon Thermo Printex Company), this resin-treated cotton cloth was printed under the common transfer conditions defined by a temperature of 200° C. and a period of 30 seconds. The resulting printed cloth showed much higher and commercially acceptable color density, as compared with the cotton cloth which was not resin-treated but printed under the same transfer conditions For purposes of comparison, a cotton cloth was pretreated with a solution containing only the acrylic resin and not the swelling agent for cellulose fiber (or triethylene glycol) was printed in the same manner as above. When compared with this printed cloth, the above-mentioned printed cloth of this example was more excellent in internal dyeability, color density, and hygroscopicity.

EXAMPLE 16

A cotton cloth was pretreated and printed in the same manner as in Example 15, except that ethylene glycol was used in place of triethylene glycol. The resulting printed cloth had excellent properties, just like that of Example 15.

Example 17 given below illustrates the case in which a solution containing a swelling agent, crosslinking agent, crosslinking catalyst, and resin capable of being dyed with oil-soluble dyes or disperse dyes in used as the pretreating solution. The printing step was carried out by the dry transfer printing process.

EXAMPLE 17

A broad cloth made of polyester (65 parts by weight)-/rayon (35 parts by weight) was dipped in a pretreating solution having the following composition, squeezed to an expression of 100%, and dried for 2 minutes in a hot-air oven at 100° C.

| Pretreating Solution | | |
|---|---|---|
| Sumitex Resin M-3 (A melamine-formalin resin manufactured by The Sumitomo Kagaku Company) | 10 | parts by weight |
| Sumitex Accelerator X-80 (A special metallic salt catalyst manufactured by The Sumitomo Kagaku Company) | 3 | parts by weight |
| Tocryl (An acrylic ester emulsion manufactured by The Toyo Ink Company) | 15 | parts by weight |
| Polyethylene Glycol 400 (A product manufactured by The Sanyo Kasei Company) | 15 | parts by weight |
| Sumitex Softener L (A softening agent manufactured by The Sumitomo Kagaku Company) | 1 | parts by weight |

Using a commercially available transfer paper (manufactured by The Toppan Printing Company) printed with an ink containing a common disperse dye, this pretreated cloth was printed under the transfer conditions defined by a temperature of 210° C., a pressure of 200 g/cm$^2$, and a period of 30 seconds, lightly washed with water, and then dried. The resulting printed cloth had very excellent crease resistance and wash-and-wear properties as well as a bright tone of color and good color fastness to washing.

Example 18 given below illustrates the case in which the cloth to be printed is acetylated after the pretreatment step and before the printing step. The pretreatment step was carried out by using a solution containing only a swelling agent, and the printing step was carried out by the dry transfer printing process.

EXAMPLE 18

Using a gravure proof press, a sheet of single starch-coated paper having a basis weight of 60 g/m$^2$ was printed on the starch-coated side with inks having the following compositions, whereby a transfer paper was formed.

| Ink A | | |
|---|---|---|
| Disperse Red No.60 | 10 | parts by weight |
| Ethyl Cellulose N-7 | 10 | " |
| Surface active agent | 1 | " |
| Isopropyl alcohol | 29 | " |
| Ethyl alcohol | 50 | " |

| Ink B | | |
|---|---|---|
| Disperse Blue No.73 | 10 | parts by weight |
| Ethyl Cellulose N-7 | 10 | " |
| Surface active agent | 1 | " |
| Isopropyl alcohol | 29 | " |
| Ethyl alcohol | 50 | " |

Then, a cotton cloth was soaked for 5 minutes in an 18% sodium hydroxide having a swelling effect, and squeezed to an expression of 100%. Thereafter, the cotton cloth was acetylated by passing through a heated solution (at 90° C.) consisting of a mixture of acetic anhydride and pyridine (10:1). After 15 minutes, the cotton cloth was removed, washed with water, and dried for 10 minutes in an oven at 100° C.

The above-mentioned transfer paper was placed on the cotton cloth so treated, and transferred under the conditions defined by a temperature of 205° C. and a period of 40 seconds. The resulting printed cloth had very excellent color fastness. The same effect was also recognized after washing the printed cloth.

On the other hand, a cloth was treated and printed in the same manner as above, dipped in a 5% aqueous solution of Gas Guard DX (manufactured by The Meisei Kagaku Kogyo Company), squeezed to an expression of 80%, and then dried. For purposes of comparison, another cloth was solely treated in the same manner as above. Still another cloth was treated in the same manner as above, dipped in a 5% aqueous solution of Gas Guard DX, squeezed to an expression of 80%, dried, and then printed. According to A.A.T.C.C. Standard RA33, these cloths were tested for color fastness to gases. The color fastness of the pretreated and post-treated cloths was found to be improved by 1 or 1–2 gradations, as compared with that of the untreated cloth.

What is claimed is:

1. A method of printing cellulose fiber and polyester/cellulose mixed fiber, comprising pretreating a cellulose fiber or polyester/cellulose mixed fiber with a solution containing (i) a swelling agent for cellulose fiber, (ii) a resin capable of being dyed with an oil-soluble dye or a disperse dye, (iii) a cross-linking agent, and (iv) a cross-linking catalyst, and then printing the resulting fiber by the dry transfer printing process using a transfer paper printed with an ink containing a sublimable, oil-soluble dye or disperse dye.

2. A method of printing as defined in claim 1 wherein acetylation is carried out after said pretreatment step and before said printing step.

3. A method of printing as defined in claim 1 wherein soaping is carried out after said pretreatment step and before said printing step.

4. A method of printing as defined in claim 1 wherein said swelling agent has a boiling point higher than about 150° C.

5. A method of printing as defined in claim 1 wherein said swelling agent has a boiling point equal to or higher than the temperature of the dry transfer printing process.

* * * * *